US005318499A

United States Patent [19]

Rice et al.

[11] Patent Number: 5,318,499

[45] Date of Patent: Jun. 7, 1994

[54] DOUGH CONTAINER WITH PREWEAKENED NON-PEEL LABEL

[75] Inventors: Michael J. Rice, St. Paul; Gregory P. Holl, Coon Rapids; Robert A. Strange, Andover, all of Minn.

[73] Assignee: The Pillsbury Company, Minneapolis, Minn.

[21] Appl. No.: 17,772

[22] Filed: Feb. 16, 1993

Related U.S. Application Data

[62] Division of Ser. No. 792,456, Nov. 15, 1991, Pat. No. 5,205,479.

[51] Int. Cl.[5] ..... B31C 3/00; B31C 3/04

[52] U.S. Cl. ..... 493/287; 493/299; 493/341

[58] Field of Search ..... 493/276, 287, 299, 300, 493/301, 341

[56] References Cited

U.S. PATENT DOCUMENTS

| | | | |
|---|---|---|---|
| 2,793,126 | 5/1957 | Fienup et al. | 99/172 |
| 2,855,884 | 10/1958 | Magill | 113/120 |
| 2,891,714 | 6/1959 | Vallas | 229/51 |
| 3,009,626 | 11/1961 | Johnson | 229/51 |
| 3,035,753 | 5/1962 | Erekson | 229/51 |
| 3,042,286 | 7/1962 | Pottle | 229/51 |
| 3,051,370 | 8/1962 | Hanlon | 229/51 |
| 3,101,885 | 8/1963 | Walsh | 229/51 |
| 3,102,818 | 9/1963 | Zoeller et al. | 99/172 |
| 3,144,193 | 8/1964 | Geist et al. | 229/51 |
| 3,214,078 | 10/1965 | Leezer | 229/51 |
| 3,221,975 | 12/1965 | Zoeller et al. | 229/51 |
| 3,241,739 | 3/1966 | Ahlemeyer | 229/51 |
| 3,506,183 | 4/1970 | Turpine et al. | 229/51 |
| 3,510,050 | 5/1970 | Culley et al. | 229/51 |
| 3,712,534 | 1/1973 | Fienup et al. | 229/51 |
| 3,724,742 | 4/1973 | Henderson | 229/51 |
| 3,933,302 | 1/1976 | Reid et al. | 229/51 |
| 3,940,496 | 2/1976 | Turpin et al. | 426/123 |
| 3,972,468 | 8/1976 | Reid | 229/51 |
| 3,981,433 | 9/1976 | Thornhill et al. | 229/51 |
| 4,091,718 | 5/1978 | Thornhill | 93/39.1 |
| 4,093,073 | 6/1978 | Leezer | 206/606 |
| 4,160,894 | 7/1979 | Stemmler et al. | 493/341 |
| 4,187,137 | 2/1980 | Beauchamp | 156/195 |
| 4,235,341 | 11/1980 | Martin et al. | 206/601 |
| 4,241,834 | 12/1980 | Beauchamp | 206/611 |
| 4,257,316 | 3/1981 | Roder et al. | 493/68 |
| 4,493,850 | 1/1985 | Fioravanti | 426/283 |
| 4,779,738 | 10/1988 | Akutsu et al. | 206/627 |
| 5,001,325 | 3/1991 | Huizinga | 493/341 |
| 5,019,028 | 5/1991 | Engel et al. | 493/341 |
| 5,076,440 | 12/1991 | Drummond | 229/202 |

FOREIGN PATENT DOCUMENTS

| | | |
|---|---|---|
| 0363693 | 4/1990 | European Pat. Off. . |
| 2618726 | 2/1989 | France . |
| 813631 | 5/1959 | United Kingdom . |

*Primary Examiner*—William E. Terrell
*Attorney, Agent, or Firm*—Kinney & Lange

[57] ABSTRACT

An easy-open, spiral wound container for packaging refrigerated dough products includes a spirally wound fibrous core layer, forming an unbonded spiral butt joint. The container also includes an inner liner layer and an outer label layer, each having a seam. The outer label layer is weakened along the butt joint to facilitate opening of the container. An end closure member seals an end of the container.

6 Claims, 3 Drawing Sheets

DOUGH CONTAINER WITH PREWEAKENED NON-PEEL LABEL

This is a Divisional of application Ser. No. 07/792,456, filed Nov. 15, 1991 U.S. Pat. No. 5,205,479.

BACKGROUND OF THE INVENTION

The present invention relates in general to containers for packaging refrigerated dough products, and a method of forming the same.

The art of constructing dough containers is well known. Dough containers fall into two general categories. They include peelable and no-peel containers. Peelable containers generally require removal of the outer layer before the container can be opened, whereas the no-peel containers do not.

Dough containers must be sufficiently strong to prevent premature rupturing and must also be easily opened. Several designs have been proposed to prevent premature rupture. One such design employs a technique of placing an inner liner seam, a butt joint and an outer label seam out of register with one another. By placing the seams out of register, the container has sufficient strength to prevent premature rupturing during shipment and storage.

An example of a dough container in which the seams are placed out of register is disclosed in Zoeller et al. U.S. Pat. No. 3,102,818. The Zoeller et al. patent discloses a container having an outer label layer, a tear element for weakening the label layer, a fiberboard core layer, and an inner liner. Seams of the outer label layer, the fiberboard core layer and the inner liner are out of register. The outer layer is modified along the butt joint to facilitate opening. One example of modification includes gluing a tear element to the label layer. When the tear element is pulled, the label layer tears and the container is weakened along the butt joint. The container may then be opened by application of a moderate indenting force to the butt joint.

Another dough container design employs a technique of partially reinforcing the butt joint to prevent premature rupturing of the container. An example of this technique is disclosed in Culley et al. U.S Pat. No. 3,510,050. Culley et al. discloses a container having a fiberboard core layer including a helical butt joint. Tensile members are positioned over at least a portion of the butt joint. The tensile members straddle the butt joint and are positioned on either the inner surface of the fiberboard layer, the outer surface of the fiberboard layer or both. The seams of the fiberboard layer, the inner liner and label layer are all in register. The tensile members which reinforce the butt joint are attached by means of a hot melt adhesive. When a sufficient force is applied to a point along the butt joint, the tensile member ruptures and the container opens.

SUMMARY OF THE INVENTION

A novel container for packaging refrigerated dough is disclosed. A preferred container includes a fibrous core layer with an unbonded helical butt joint extending the length of the container. The container includes an impervious inner liner having a helical seam which is proximate to and slightly out of register with the butt joint. A label layer is adhesively bonded to an outer surface of the fibrous core layer. The label layer includes an overlapping seam which in a preferred embodiment is helical and is out of register with the butt joint The butt joint is held together by the inner liner and the label layer, both layers being adhesively bonded to the core layer.

The label layer in the preferred embodiment is formed of a biaxially oriented polymer film. The label layer is weakened along the butt joint by a means for weakening the label layer. In a preferred embodiment, the means for weakening comprises a plurality of perforations positioned proximate the butt joint, which upon application of pressure ruptures along the butt joint, causing the container to open.

The present invention also includes a novel method of manufacturing a composite dough container for refrigerated dough products. The method includes helically winding an impervious inner liner layer strip upon a mandrel, forming an overlapping spiral seam. A fibrous core strip is wound onto the same mandrel and adhesively bonded to the inner liner. The fibrous core includes an unbonded butt joint which is slightly out of register with the inner liner seam. A label layer is helically wound onto the fibrous core layer to form an overlapping spiral seam, and is adhesively bonded to the fibrous core layer. The seam of the label layer is preferably out of register with the butt joint.

The label layer preferably is perforated along a defined line directly above the butt joint. In a preferred embodiment, an area surrounding each perforation is heat treated to reinforce the perforations and prevent premature rupture during storage and shipping. This heat treating prevents premature tearing of the label layer. At least one end of the composite container is sealed with a closure member.

DETAILED DESCRIPTION OF THE PREFERRED EMBODIMENTS

"Rollstock" for purposes of this disclosure is defined as a flexible packaging material wound onto a cylindrical core which is available in the form of a roll.

Figure 1:
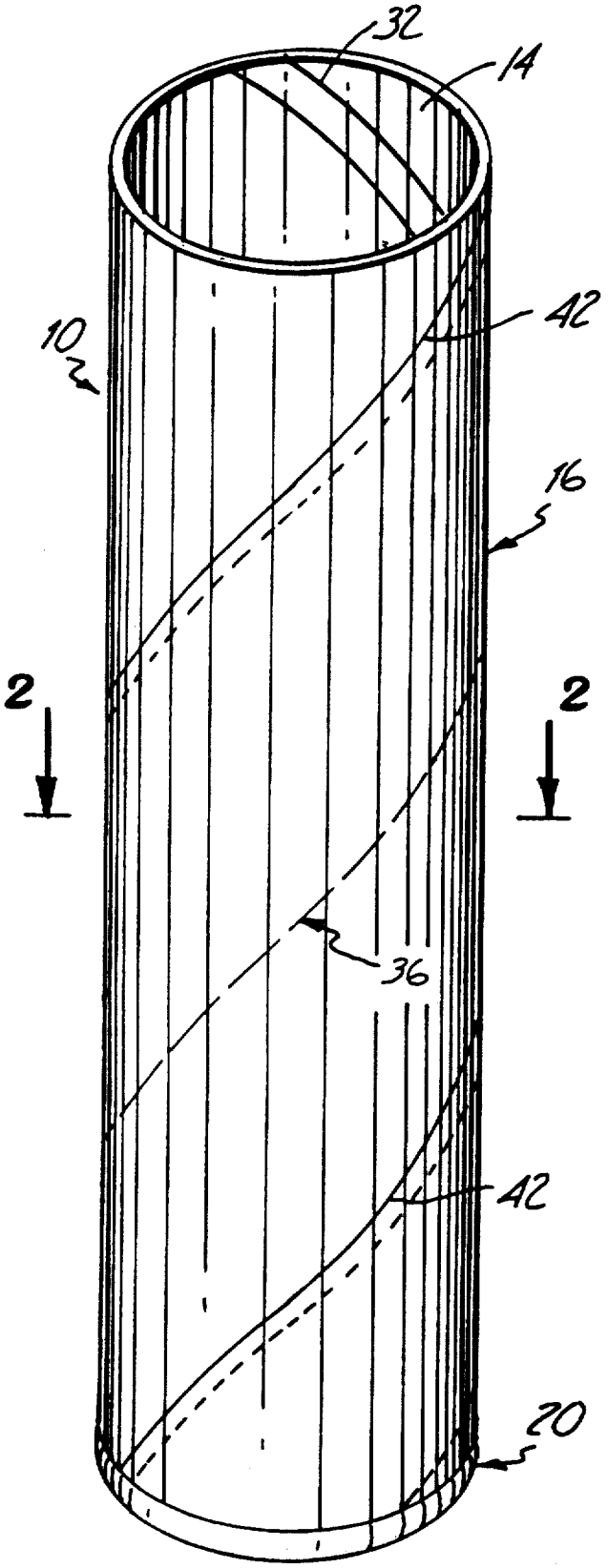
FIG. 1 is a perspective view of a composite container of the present invention.
Figure 2:
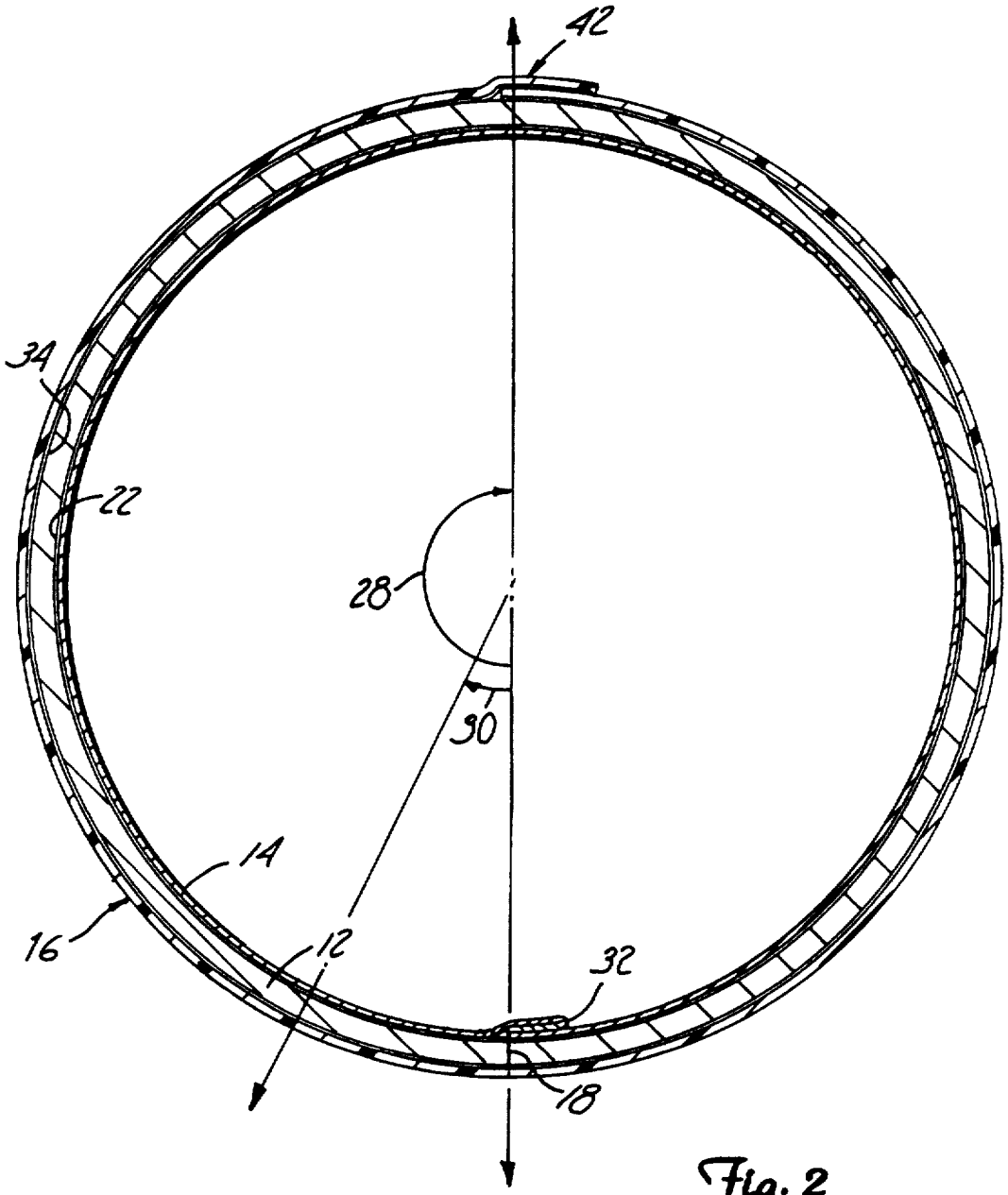
FIG. 2 is an enlarged cross-sectional view of the container taken along the reference line 2—2 shown in FIG. 1.

FIG. 1 is a perspective view of a composite container 10 in accordance with the present invention. An enlarged cross-sectional view of the composite container 10 of the present invention taken along line 2—2 as shown in FIG. 1 is shown in FIG. 2. The container 10 includes a fibrous core layer 12, an impermeable inner liner layer 14, and an outer label layer 16. The inner liner layer in the preferred embodiment is formed from rollstock. The fibrous core layer 12 of the container 10 includes a helical butt joint 18, which is unbonded in the preferred embodiment and extends the length of the container 10 The composite container 10 includes a metal end member 20 single crimped onto the end of the container 10. Although the preferred embodiment is most suitable for atmospheric pressure packaging, the container of the present invention is also suitable for vacuum packaging. A preferred vacuum container includes double crimped ends, as shown, in McDilda et al.

U.S. Pat. No. 5,084,284, Ser. No. 07/638,390, Filed Jan. 7, 1991.

The high barrier inner liner layer 14 is formed from flexible rollstock material which may be paper, foil, polymeric substrates and laminates thereof. In a preferred embodiment, the high barrier inner liner layer 14 is formed from a laminate of paper, foil, and polyethylene. The inner liner material is selected such that it is substantially impermeable to moisture, grease, and gasses.

The fibrous core layer 12 is preferably formed from heavy paperboard having a thickness of at least 0.014 inches. The core layer thickness must be selected to provide structural support to withstand the selected environment. For example, a preferred core layer thickness of 0.021 inches is suitable for withstanding vacuum packing environments as low as 5 inches of mercury (absolute). If the container is to be exposed to only pressure environments, a thinner core layer material could be used.

It was surprisingly discovered that a container having an adhesively bonded outer label layer 16 formed from a biaxially oriented polymer film is sufficiently strong to hold the container 10 together when the container 10 is packed with pressurized dough. The leavening agents in the dough commonly cause the internal pressure in a dough container to exceed 25 p.s.i.g. during refrigerated storage.

The label layer 16 typically contains printed matter, such as an illustration or directions, and serves to protect the fibrous core layer 12 from moisture. Label layer materials may include paper, foil, film, emulsions, coatings and laminates of these materials. A suitable biaxially oriented polymer film label layer is Quantum 250 CW® available from Quantum Performance Films of 601 East Lake Street, Streamwood, Ill. 60107 although any label material of sufficient strength may be used.

The inner liner layer 14 is adhesively bound to an inner surface of the fibrous core layer 12 by means of a dry bond adhesive layer 22. A preferred adhesive 22 is available by ordering adhesive 1940-A from H. B. Fuller of St. Paul, Minn. Inner liner layer 14 includes an anaconda-type fold proximate the butt joint 18.

Figure 3:
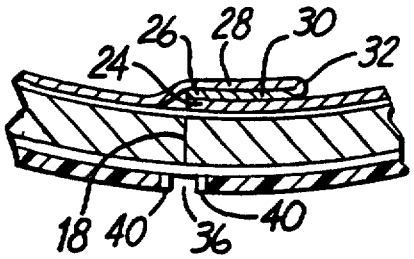
FIG. 3 is an enlarged cross-sectional view of a butt joint shown in FIG. 2.
Figure 4:
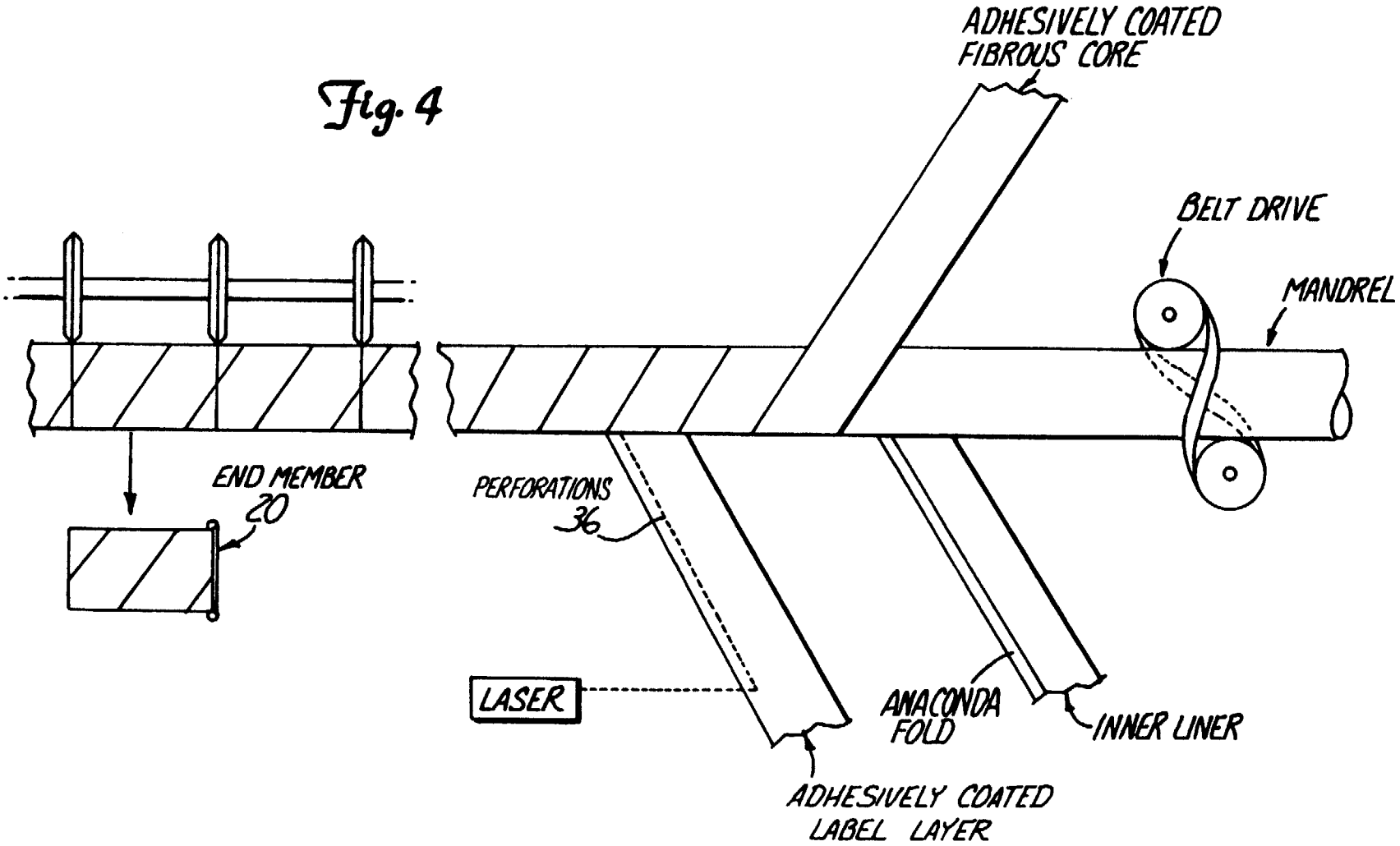
FIG. 4 is a diagrammatical view of a process of making the container of the present invention.

FIG. 3 is an enlarged cross-sectional view of the butt joint 18 shown in FIG. 2. In the preferred embodiment, a first edge 24 of the inner liner 14 terminates substantially adjacent to the butt joint 18. A second edge 26 of the inner liner 14 is infolded and meets the first edge 24, overlapping the butt joint 18 forming a seal. The overlapping portions of the inner liner 14 are heat sealed in the preferred embodiment. The fold 32 of the second edge 26 is preferably offset slightly from the butt joint 18 by about 3/16" to help reinforce the butt joint 18. This type of fold is referred to in the trade as an "anaconda" type fold. The fold described above is preferably close enough to the butt joint 18 to allow the joint 18 to open upon application of force to the label layer at the butt joint. While this is the preferred embodiment, other liner fold positions can be used.

Referring back to FIG. 2, the outer label layer 16 is adhesively bonded to an outer surface of the fibrous core 12 by means of an adhesive layer 34. An appropriate adhesive is a polyvinyl alcohol (PVA) adhesive. One example can be obtained by ordering Adhesive No. 2057-3 from H. B. Fuller of St. Paul, Minn. The outer label layer 16 includes an unfolded, overlapping seam 42. Seam 42 in the preferred embodiment is spaced apart and is out of register with the butt joint 18 by about 180°, shown as angle 28. The seam 42 should be spaced a minimum of 30° from the butt joint 18, shown as angle 30. In another preferred embodiment (not shown), the seam 42 is positioned 70° from the butt joint 18.

The label layer 16 is weakened in the preferred embodiment by a plurality of spaced apart perforations 36 (shown greatly exaggerated for purposes of illustration) arranged in a line and positioned substantially over the butt joint 18. These perforations may be formed by mechanical means such as a punch or a perforation wheel as known to those skilled in the art or by non-mechanical means such as a laser either before or during winding of the can. In the preferred embodiment, each perforation 36 is surrounded and reinforced by a heat affected area 40. Heat affected areas 40 prevent the perforations 36 from prematurely propagating tears along the line of perforations 36 during shipment or storage. A laser beam is a preferred device for both forming the perforations 36 and forming the heat affected areas 40. The laser beam forms the perforation and anneals the heat affected areas 40 virtually at the same time. In a preferred embodiment a $CO_2$ laser suitable for providing perforations in a pulsed manner of 5/1O,OOO to 4/1,000 inch diameter can be used. The spacing between perforations can range from about 0.1 inches to 0.01 inches. In the preferred embodiment, a 3/1,000 hole size and 0.1 inches spacing center-to-center were suitable for use with the above-mentioned Quantum 250 CW® polypropylene film.

The size of the perforations, the number of perforations and the position of the perforations relative to the butt joint in part depend upon the physical properties of the label material. The material should be selected such that it is strong enough after pre-weakening that the containers remain intact during storage and during transportation and handling. Also, the label layer should be selected such that at least one tear will propagate from one or more of the perforations upon application of pressure to the butt joint, and continue to tear when the butt joint opens from the internal pressure in the container.

An example of a suitable label layer is a biaxially oriented polypropylene plastic having a thickness of about 0.0012 inches. It was surprisingly discovered that the size of the perforations did not effect performance significantly with this film and that perforations between 5/10,000 and 4/1,000 in diameter functioned adequately Center-to-center spacings of 0.1 inch worked the best.

In this example, as well as the most preferred example, the perforations were evenly spaced along a line positioned substantially in alignment with the butt joint. Although perforations in the label layer are preferably located directly above the butt joint, perforations near the butt joint, particularly lines of perforations on either side of the butt joint would also be sufficient to pre-weaken the label layer 16.

The preferred laser for perforating the label layer 16 is an Everlase S48 available from Coherent General Laser. However, any $CO_2$ laser of 50 watts power or higher would work. Although the perforations were placed in the label layer after application to the core layer in the preferred embodiment, the present invention contemplates forming the perforations in the label layer before winding the label onto the core.

After forming a continuous cylinder, the cylinder is cut to length to form dough containers. A metal end member 20 is preferably placed on one end of each container prior to inserting a dough product. After insertion, a second end member (not shown) is placed on the opposite end.

The container 10 as shown in FIG. 1 may be opened by pressing along the butt joint with a blunt object such as a spoon. The application of such force causes the outer label layer 16 to break along the line of perforations 36, exposing the unbonded butt joint 18 The pressure from the dough product inside the container is then sufficient to break the inner liner seam exposing the dough product. The dough product is then released from the container 10 by grasping the opposite ends of the container and twisting in opposite directions.

The composite container 10 of the present invention is formed preferably by a process which uses a belt driven composite container winder 40. As the belt rotates, a continuous strip of inner liner rollstock material is deposited onto the winder at an angle with respect to the cylindrical axis of the mandrel of the container winder. The angle Θ is other than 90°. Next, a continuous strip of fibrous core material which is adhesively coated on the surface facing the impermeable inner liner layer 14 is deposited onto the winder. The abutting edges of the fibrous core strip define the unbonded helical butt joint 18. As the belt rotates, the impermeable inner liner 14 and the fibrous core 12 are joined and form a continuous cylinder. A helical joint defined by overlapping edges of the inner liner 14 preferably includes a heat sealed anaconda fold proximate the butt joint 18.

A label layer 16 is adhesively applied to the fibrous core 12. The label layer 16 includes a plurality of perforations 36 and heat treated areas 40 surrounding each perforation which are spaced apart along a line and are aligned and in register with the helical butt joint 18 of the fibrous core 12. The perforations 36 are created by means of a laser beam 42 according to the preferred method which also heats the areas immediately surrounding each perforation in the label layer to provide heat affected areas 40. Although the perforations 36 are created after applying the label layer 16 in the preferred embodiment, it would be possible to apply the perforations 36 before applying the label layer 16 to the core layer 12. The label layer 16 in the preferred embodiment carries printed matter and serves to protect the fibrous core layer 12 from moisture.

As the container 10 is formed, the tube is cut to a plurality of discrete lengths 11. An end member 20 is preferably placed onto one end of the container prior to inserting a dough product. After inserting the product, the container may be sealed by applying a second end member 20 (not shown) to the open end.

The composite container of the present invention includes an inner liner, a fibrous core, and a label layer which is weakened proximate a butt joint in the fibrous core. The container of the present invention opens easily without compromising the strength of the container. In the preferred embodiment, the strength of the biaxially oriented polymer film is sufficient to hold the container together during shipment and storage. The perforations along the butt joint weaken the outer label layer so that the container is easily opened by application of a moderate indenting force to the butt joint. The perforations are reinforced with a heat affected area to prevent premature tearing of the outer label layer. It is significant to the present invention that only one step is used to open the container.

Although the present invention has been described with reference to preferred embodiments, workers skilled in the art will recognize that changes be made in form and detail without departing from the spirit and scope of the invention.

What is claimed is:

1. A method of manufacturing a composite container for a refrigerated dough product, comprising:

forming a composite tube comprising the steps of:

helically winding an inner liner upon a mandrel to form a helically wound inner liner having an overlapping helical seam helically winding a fibrous core strip over the helically wound inner liner to form a helically wound fibrous core having an unbonded spiral butt joint located proximate the helical seam;

adhesively bonding the fibrous core to the inner liner;

forming a line of perforations in an outer label layer;

reinforcing an area surrounding the perforations by creating a heat affected area through an application of heat;

helically winding the label layer around the helically wound fibrous core strip, wherein the perforations are each located substantially over the butt joint; and adhesively bonding the label layer to the fibrous core; and securing an end closure member to an end of the composite tube.

2. The method of claim 1 wherein the forming of a plurality of perforations in the label layer weakens the label layer enough such that upon application of force to the butt joint, the label will rupture, wherein the label layer after perforating is of a sufficient strength to hold together during manufacturing, shipment and storage.

3. The method of claim 2 wherein forming the plurality of perforations comprises perforating the label layer with a laser beam.

4. The method of claim 2 wherein the perforations are made prior to winding the label layer onto the core.

5. The method of claim 1 including forming an anaconda fold in the helically wound inner liner.

6. The method of claim 5 wherein the anaconda fold is proximate the unbonded spiral butt joint.

* * * * *